US006724900B2

(12) United States Patent
Fujino

(10) Patent No.: US 6,724,900 B2
(45) Date of Patent: Apr. 20, 2004

(54) HEARING AID

(75) Inventor: Shouji Fujino, Tokyo (JP)

(73) Assignee: Temco Japan Co., Ltd., Tokyo (JP)

( * ) Notice: Subject to any disclaimer, the term of this patent is extended or adjusted under 35 U.S.C. 154(b) by 14 days.

(21) Appl. No.: 10/030,713

(22) PCT Filed: May 11, 2001

(86) PCT No.: PCT/JP01/03936

§ 371 (c)(1),
(2), (4) Date: Jan. 14, 2002

(87) PCT Pub. No.: WO01/87012

PCT Pub. Date: Nov. 15, 2001

(65) Prior Publication Data

US 2002/0106094 A1 Aug. 8, 2002

(30) Foreign Application Priority Data

May 12, 2000 (JP) ..... 2000-140512

(51) Int. Cl.[7] ..... H04R 25/00

(52) U.S. Cl. ..... 381/315; 381/312; 381/315; 381/331; 381/314; 381/323; 381/316; 381/317

(58) Field of Search ..... 381/312, 315, 381/331, 314, 323, 316, 317

(56) References Cited

U.S. PATENT DOCUMENTS 3,659,056 A * 4/1972 Morrison et al. ..... 381/331

FOREIGN PATENT DOCUMENTS

| | | |
|---|---|---|
| JP | 60-55800 A | 4/1985 |
| JP | 9-182192 A | 7/1997 |
| JP | 10-285696 A | 10/1998 |

* cited by examiner

*Primary Examiner*—Sinh Tran
(74) *Attorney, Agent, or Firm*—Browdy and Neimark

(57) ABSTRACT

To provide a hearing aid that allows desired sound to be selectively heard and allows unnecessary sound not to be heard, and that can be used with no bars even in a situation like a meeting that requires a conversation with a plurality of persons. The hearing aid includes: a hearing aid body having a hearing aid function and an external microphone signal receiving function; and a separate external microphone, wherein connection and disconnection of communication between the above described hearing aid body and the external microphone are automatically switched, and the above described hearing aid body functions as a normal hearing aid when the communication between the above described hearing aid body and the external microphone is disconnected.

3 Claims, 2 Drawing Sheets

(PRIOR ART)

HEARING AID

REFERENCE TO RELATED APPLICATIONS

The present application is the national stage under 35 U.S.C. 371 of international application PCT/JP01/03936, filed May 11, 2001 which designated the United States, and which international application was not published under PCT Article 21(2) in the English language.

BACKGROUND OF THE INVENTION

1. Field of the Invention

The present invention relates to a hearing aid, and more particularly to a hearing aid allowing necessary sound only to be selectively heard.

2. Description of the Related Art

General microphones of hearing aids, of whatever type such as a type being inserted into an external auditory meatus, a type being used hung on an ear, or a type being separated from a hearing aid body, are used attached around ears or to bosoms.

Those need hearing aids have relatively narrow dynamic ranges. Thus, in the above described fixed microphone of the conventional hearing aid, microphone gain is set high to obtain an appropriate input level, and automatic gain control (AGC) is sufficiently performed, thereby allowing sudden loud sound such as impulsive sound to be appropriately reduced and transmitted.

FIG. 2 is a block diagram showing a configuration example of a conventional hearing aid. A microphone 33 picks up an audio signal, and an automatic gain controller 34 detects variation in amplitude of the audio signal and automatically controls gain of an amplifier so as to keep the amplitude of the output signal constant, and the signal is amplified by a microphone amplifier 35, frequency corrected by an equalizer 36, and with a power amplifier 37 driven, output from a speaker 38.

However, the conventional hearing aid reacts to unintentional and unnecessary sound such as a rubbing sound of newspaper when a user reads a newspaper, and operates, and the sound is amplified to thereby make the user uncomfortable.

Also, the automatic gain control is performed in accordance with voice of a nearby person or voice of a loud person to sometimes cause difficulty in catching voices of other persons, so that the conventional hearing aid is not suitable for a situation like a meeting that requires a conversation with a plurality of persons.

The present invention is achieved in view of the above described problems of the conventional art, and has the object to provide a hearing aid that allows desired sound to be selectively heard and allows unnecessary sound not to be heard, and that can be used with no bars even in a situation like a meeting that requires a conversation with a plurality of persons.

SUMMARY OF THE INVENTION

The above described problem is solved by a hearing aid according to the present invention, including: a hearing aid body having a hearing aid function and an external microphone signal receiving function; and a separate external microphone, wherein connection and disconnection of communication between the above described hearing aid body and the external microphone are automatically switched, and the above described hearing aid body functions as a normal hearing aid when the communication between the above described hearing aid body and the external microphone is disconnected.

Preferably, the communication between the above described hearing aid body and the external microphone is wireless communication, the communication between the above described hearing aid body and the external microphone is disconnected when the above described hearing aid body and the external microphone are joined, and the communication therebetween are connected when the above described external microphone is separated from the above described hearing aid body.

DETAILED DESCRIPTION OF THE PREFERRED EMBODIMENTS

Figure 1:
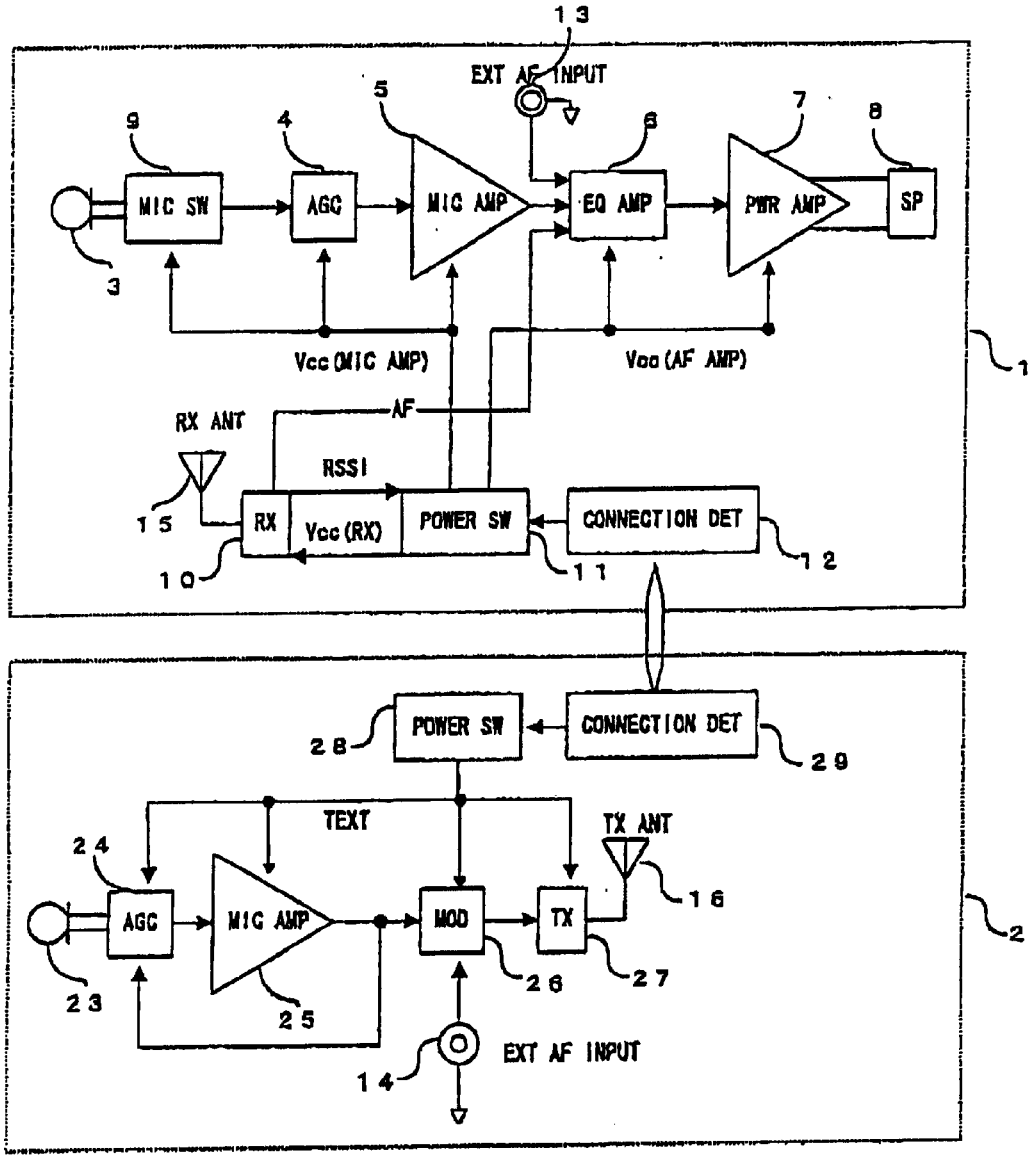
FIG. 1 is a block diagram showing a configuration of a hearing aid according to the present invention.

An embodiment of the present invention will be described with reference to the attached drawings. FIG. 1 is a block diagram showing a configuration of a hearing aid according to the present invention. The hearing aid comprises a hearing aid body 1 having a hearing aid function and an external microphone receiving function, and an external microphone 2 connected thereto wirelessly or with wire.

Figure 2:
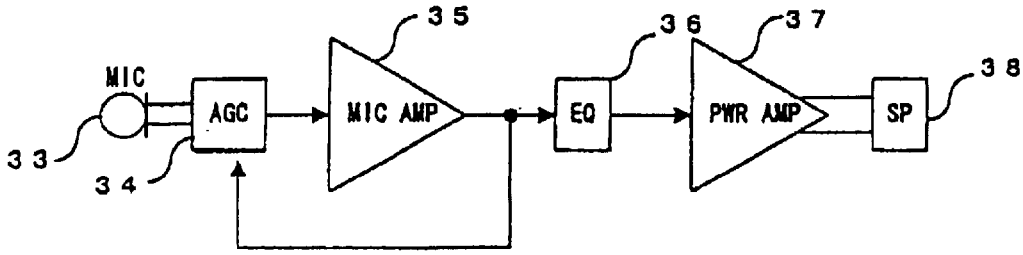
FIG. 2 is a block diagram showing a configuration of a conventional hearing aid.

The hearing aid body 1 has the hearing aid function based on a conventional hearing aid shown in FIG. 2. Specifically, the body 1 comprises a fixed microphone 3, an automatic gain controller 4 that detects variation in amplitude of an audio signal picked up by the fixed microphone 3 and automatically controls gain of an amplifier so as to keep the amplitude of the output signal constant, a microphone amplifier 5, an equalizer amplifier 6 correcting frequency, a power amplifier 7 and a speaker 8.

The body 1 is also provided with a microphone switch 9 and an external microphone receiving unit 10 between the fixed microphone 3 and the automatic gain controller 4, and operation of the external microphone receiving unit 10 causes operation of the microphone switch 9, thus automatically switching between the fixed microphone 3 and a below mentioned external microphone 2. The body 1 is further provided with a power switch 11 supplying power to each circuit and a connection detecting circuit 12 detecting connection/disconnection with the external microphone 2, and moreover provided with an external input terminal 13 as required.

In the other hand, the external microphone 2 has an external microphone 23, an automatic gain controller 24 and a microphone amplifier 25, and also has a modulator 26 and a transmitting circuit 27. The external microphone 2 is further provided with a power switch 28 supplying power to each circuit and a connection detecting circuit 29 detecting connection/disconnection with the body 1, and moreover provided with an external input terminal 14 as required The body 1 and the external microphone 2 are connected with wire or wirelessly. Wireless transmission/receiving is made by radio waves or infrared radiation. In an example shown in FIG. 1, the transmission/receiving is made by the radio waves, and thus a receiving antenna 15 is shown in the external microphone receiving unit 10 of the body 1, and a transmitting antenna 16 is shown in the transmitting circuit 27 of the external microphone 2. When the transmission/ receiving is made by the infrared radiation, a light-emitting diode and a light receiving element are used instead of the transmitting antenna 16 and the receiving antenna 15.

In the above described configuration, when the external microphone 2 is connected to the body 1, the connection detecting circuit 12 operates to turn on the power switch 11 of the body 1 to thereby turn on the microphone switch 9 of the fixed microphone 3 of the body 1, thus supplying power to each circuit of the hearing aid. In this case, power is not supplied to the external microphone receiving unit 10, and the external microphone receiving unit 10 does not operate.

When the external microphone 2 is separated from the body 1, the connection detecting circuit 12 of the body 1 detects it to stop supplying power to the microphone amplifier 5, thereby turning off input from the fixed microphone 3. On the other hand, power is supplied to the external microphone receiving unit 10 and an AF amplifier to start operation of the external microphone receiving unit 10.

The connection detecting circuit 29 of the external microphone 2 detects that the external microphone 2 is separated from the body 1, and then turns on the power switch 28 to start operation of the external microphone 2. In the external microphone 2, sound picked up by the external microphone 23 is level adjusted by the automatic gain controller 24, appropriately amplified by the microphone amplifier 25, then modulated by the modulator 26, and transmitted from the transmitting antenna 16 via the transmitting circuit 27.

A signal transmitted from the external microphone 2 is received by the receiving antenna 15 of the body 1, demodulated by the external microphone receiving unit 10, and input in the equalizer amplifier 6 as an AF signal, and with the power amplifier 7 driven, output from the speaker 8.

When the radio wave received by the receiving antenna 15 becomes weak to make it impossible to detect RSSI (Receiving Signal Strength Indication) from the received signal, the power switch 11 stops supplying power to the external microphone receiving unit 10, and supplies microphone amplifier power to a hearing aid circuit instead to operate the hearing aid of the body 1.

Two external input terminals provided on the body 1 and the external microphone 2 are jacks for direct input of sound from a television or a radio, and the jack is not necessarily required to be provided on each of them, but may be provided on either of them, especially on the external microphone 2.

When having an one-on-one conversation in a quiet situation, a user hears sound collected by the fixed microphone 3 incorporated in the body 1 without separating the external microphone 2. When reading a newspaper or a book without conversation, the user separates and places nearby the external microphone 2 to turn off the fixed microphone 3 of the body 1, and when the external microphone 2 picks up sound, the external microphone receiving unit 10 of the body 1 receives the sound and transmit it to the user.

If the external microphone receiving unit 10 of the body 1 comes to be unable to receive the signal from the external microphone 2 in operation when the user stands and goes to another room with the external microphone 2 left as it is or goes out with the external microphone 2 left behind, the external microphone receiving unit 10 automatically stops operation, the hearing aid circuit of the body 1 starts operation instead, and the fixed microphone 3 of the body 1 is brought into operation to allow the hearing aid to function as a normal hearing aid.

For this object, output of the radio wave of the external microphone 2 may be low, and a transmission/receiving area with a radius on the order of 10 (m) may be sufficient. A size of the transmitting circuit of the external microphone 2 can be reduced to allow use for long hours with a small capacity built-in battery.

In a conversation with a plurality of persons sitting around a meeting table with the user at some distance, the user can separate the external microphone 2 and place it on a center of the table, and thus can simultaneously hear comments of the plurality of persons at the same level regardless of distances from the user.

In the above described embodiment, the external microphone 2 is a wireless microphone, but instead of the wireless microphone, a wired microphone may be connected by a cord spool or the like to operate the external microphone receiving unit 10 when a cord is drawn.

The present invention is as described above, and is useful as a hearing aid that allows a sound source to be heard to be selected and allows voices of a plurality of speaking persons to be simultaneously heard regardless of distances from a user, and particularly suitable for a situation like a meeting that requires a conversation with a plurality of persons.

What is claimed is:

1. A hearing aid comprising:

a hearing aid body having a hearing aid function and an external microphone signal receiving function; and an external microphone separate from the hearing aid body, wherein connection and disconnection of communication between said hearing aid body and the external microphone are automatically switched, and said hearing aid body functions as a normal hearing aid when the communication between said hearing aid body and the external microphone is disconnected, wherein the communication between said hearing aid body and the external microphone is disconnected when said hearing aid body and the external microphone are joined, and the communication therebetween are connected when said external microphone is separated from said hearing aid body.

2. The hearing aid according to claim 1, wherein the communication between said hearing aid body and the external microphone is wireless communication.

3. The hearing aid according to any claims 1 and 2, wherein an external input terminal is provided on said hearing aid body and/or said external microphone.

* * * * *